US008468025B2

(12) United States Patent
Liu et al.

(10) Patent No.: US 8,468,025 B2
(45) Date of Patent: Jun. 18, 2013

(54) METHOD AND APPARATUS FOR PROCESSING SIGNAL

(75) Inventors: Zexin Liu, Beijing (CN); Lei Miao, Beijing (CN); Longyin Chen, Beijing (CN); Chen Hu, Shenzhen (CN); Herve Marcel Taddei, Voorburg (NL); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/172,509

(22) Filed: Jun. 29, 2011

(65) Prior Publication Data

US 2011/0320211 A1 Dec. 29, 2011

Related U.S. Application Data

(63) Continuation of application No. PCT/CN2009/076266, filed on Dec. 30, 2009.

(30) Foreign Application Priority Data

Dec. 31, 2008 (CN) ..... 2008 1 0192947
Feb. 16, 2009 (CN) ..... 2009 1 0004181

(51) Int. Cl.
*G10L 19/00* (2006.01)

(52) U.S. Cl.
USPC ..... 704/500; 704/200; 704/205; 704/206; 704/501; 704/502

(58) Field of Classification Search
None
See application file for complete search history.

(56) References Cited

U.S. PATENT DOCUMENTS

| | | | | |
|---|---|---|---|---|
| 5,956,686 | A | 9/1999 | Takashima et al. | |
| 2003/0187663 | A1 * | 10/2003 | Truman et al. | 704/500 |
| 2004/0049383 | A1 | 3/2004 | Kato et al. | |
| 2005/0288923 | A1 | 12/2005 | Kok | |
| 2006/0247923 | A1 | 11/2006 | Chandran et al. | |
| 2007/0219785 | A1 | 9/2007 | Gao | |

(Continued)

FOREIGN PATENT DOCUMENTS

| | | | |
|---|---|---|---|
| CN | 1121620 | A | 5/1996 |
| CN | 1493073 | A | 4/2004 |

(Continued)

OTHER PUBLICATIONS

Written Opinion of the International Searching Authority related to Application No. PCT/CN2009/076266; filed Dec. 30, 2009; mailed Apr. 8, 2010 (6 pgs.).

(Continued)

*Primary Examiner* — Leonard Saint Cyr
(74) *Attorney, Agent, or Firm* — Conley Rose, P.C.; Grant Rodolph; Nicholas K. Beaulieu

(57) ABSTRACT

A method and an apparatus for processing a signal are provided. The method includes: obtaining an energy average value of each sub-band for a current frame frequency-domain signal; obtaining a current frame modification coefficient of each sub-band for the current frame frequency-domain signal according to a spectral envelope and the energy average value of each sub-band; obtaining a weighted modification coefficient of each sub-band for the current frame frequency-domain signal by using the current frame modification coefficient and a relevant frame modification coefficient; and modifying the spectral envelope of each sub-band for the current frame frequency-domain signal by using the weighted modification coefficient.

20 Claims, 5 Drawing Sheets

U.S. PATENT DOCUMENTS

| | | | | |
|---|---|---|---|---|
| 2008/0189104 | A1 | 8/2008 | Zong et al. | |
| 2009/0196434 | A1 | 8/2009 | Sugiyama et al. | |
| 2009/0201983 | A1 * | 8/2009 | Jasiuk et al. | 375/240 |
| 2010/0250261 | A1 * | 9/2010 | Laaksonen et al. | 704/500 |

FOREIGN PATENT DOCUMENTS

| | | | |
|---|---|---|---|
| CN | 1684143 | A | 10/2005 |
| CN | 1770264 | A | 5/2006 |
| CN | 101300623 | A | 11/2008 |
| EP | 1158494 | A1 | 11/2001 |
| JP | 2008/309955 | A | 12/2008 |
| WO | WO 2010/075789 | A1 | 7/2010 |

OTHER PUBLICATIONS

International Search Report related to Application No. PCT/CN2009/076266; mailed Apr. 8, 2010 (6 pgs.).

Extended European Search Report Communication pursuant to Rule 62 EPC, the supplementary European search report (Art. 153(7) EPC) and the European search opinion related to Application No. 09836076.1-2225 (PCT/CN2009/076266); mailed Oct. 26, 2011; Huawei Tech Co Ltd. (7 pgs.).

Foreign communication From a Counterpart Application, European Application 09836076.1, European Office Action dated Feb. 4, 2013, 5 pages.

* cited by examiner

METHOD AND APPARATUS FOR PROCESSING SIGNAL

CROSS-REFERENCE TO RELATED APPLICATIONS

This application is a continuation of International Application No. PCT/CN2009/076266, filed on Dec. 30, 2009, which claims priority to Chinese Patent Application No. 200810192947.1, filed on Dec. 31, 2008 and Chinese Patent Application No. 200910004181.4, filed on Feb. 16, 2009, all of which are hereby incorporated by reference in their entireties.

FIELD OF THE INVENTION

The present invention relates to the field of communications technologies, and in particular, to a method and an apparatus for processing a signal.

BACKGROUND OF THE INVENTION

In conventional audio encoding/decoding algorithms, more quantization noises are introduced in an output signal due to an inaccurate quantization process in a case that the number of bits is small.

For example, in Adaptive Differential Pulse Code Modulation (ADPCM) encoding, if a very small number of bits is allocated to each sample point, too many quantization noises are introduced in the output signal due to an excessively high quantization error. Alternatively, in band spreading, generally only envelope information of some frequency spectra is transferred from an encoder to a decoder due to limitation of the number of bits, and a fine structure is generally obtained from a frequency spectrum of a low band. Although low-frequency fine structure and high-frequency fine structure have a certain correlation, some differences still exist. Therefore, the output signal obtained through a band spreading algorithm generally has some noises. Alternatively, due to limitations of other algorithms, some man-made noises are also introduced in the output signal.

In order to solve the foregoing problems, an encoding/decoding algorithm is proposed in the prior art, which has a main principle of performing post-processing on a frequency-domain signal according to a Signal-to-Noise Ratio (SNR) of the signal. The algorithm in the prior art has some effects on removal of noises among harmonic signals when a frequency-domain resolution is high, and can also make the frequency spectra of non-harmonic signals become flat.

However, in the implementation of the present invention, the inventors find that the prior art has at least the following problems:

As the post-processing of the frequency-domain signal is performed according to the SNR of the signal in the prior art, the output signal processed by using the algorithm in the prior art still has the problem of great noises.

SUMMARY OF THE INVENTION

The present invention is directed to a method and an apparatus for processing a signal, so as to reduce noises in an output signal, and improve the quality of the output signal.

The present invention adopts the following technical solutions.

A method for processing a signal is provided, where the method includes:

obtaining an energy average value of each sub-band for a current frame frequency-domain signal;

obtaining a current frame modification coefficient of each sub-band for the current frame frequency-domain signal according to a spectral envelope and the energy average value of each sub-band;

obtaining a weighted modification coefficient of each sub-band for the current frame frequency-domain signal by using the current frame modification coefficient and a relevant frame modification coefficient; and modifying the spectral envelope of each sub-band for the current frame frequency-domain signal by using the weighted modification coefficient.

An apparatus for processing a signal is provided, where the apparatus includes:

an obtaining unit, configured to obtain an energy average value of each sub-band for a current frame frequency-domain signal;

a current frame modification coefficient obtaining unit, configured to obtain a current frame modification coefficient of each sub-band for the current frame frequency-domain signal according to a spectral envelope and the energy average value of each sub-band;

a weighted modification coefficient obtaining unit, configured to obtain a weighted modification coefficient of each sub-band for the current frame frequency-domain signal by using the current frame modification coefficient and a relevant frame modification coefficient; and a modifying unit, configured to modify the spectral envelope of each sub-band for the current frame frequency-domain signal by using the weighted modification coefficient.

A method for processing a signal is provided, where the method includes:

obtaining an amplitude of at least one frequency-domain coefficient of a current frame frequency-domain signal;

comparing the amplitude of the at least one frequency-domain coefficient with an amplitude average value of frequency-domain coefficients, and obtaining at least one current frame modification coefficient corresponding to the at least one frequency-domain coefficient, where the amplitude average value of the frequency-domain coefficients is an amplitude average value of at least two consecutive frequency-domain coefficients in the current frame frequency-domain signal, and the at least two consecutive frequency-domain coefficients include the least one current frequency-domain coefficient;

obtaining a weighted modification coefficient of the current frame frequency-domain signal corresponding to the at least one frequency-domain coefficient by using the at least one current frame modification coefficient and a relevant frame modification coefficient; and modifying the corresponding at least one frequency-domain coefficient of the current frame frequency-domain signal by using the weighted modification coefficient.

An apparatus for processing a signal, where the apparatus includes:

an obtaining unit, configured to obtain an amplitude of at least one frequency-domain coefficient of a current frame frequency-domain signal;

a current frame modification coefficient obtaining unit, configured to compare the amplitude of the at least one frequency-domain coefficient with an amplitude average value of the frequency-domain coefficients, and obtain at least one current frame modification coefficient corresponding to the at least one frequency-domain coefficient, where the amplitude average value of the frequency-domain coefficients is an amplitude average value of at least two consecutive frequency-domain coefficients in the current frame frequency-domain signal, and the at least two consecutive frequency-domain coefficients include the least one current frequency-domain coefficient;

a weighted modification coefficient obtaining unit, configured to obtain a weighted modification coefficient of the current frame frequency-domain signal corresponding to the at least one frequency-domain coefficient by using the at least one current frame modification coefficient and a relevant frame modification coefficient; and a modifying unit, configured to modify the corresponding at least one frequency-domain coefficient of the current frame frequency-domain signal by using the weighted modification coefficient.

DETAILED DESCRIPTION OF THE EMBODIMENTS

To illustrate the technical solutions according to the embodiments of the present invention more clearly, the accompanying drawings for describing the embodiments are introduced briefly in the following. Apparently, the accompanying drawings in the following description show only some embodiments of the present invention, and persons of ordinary skill in the art can derive other drawings from the accompanying drawings without creative efforts.

Embodiment 1

Figure 1:
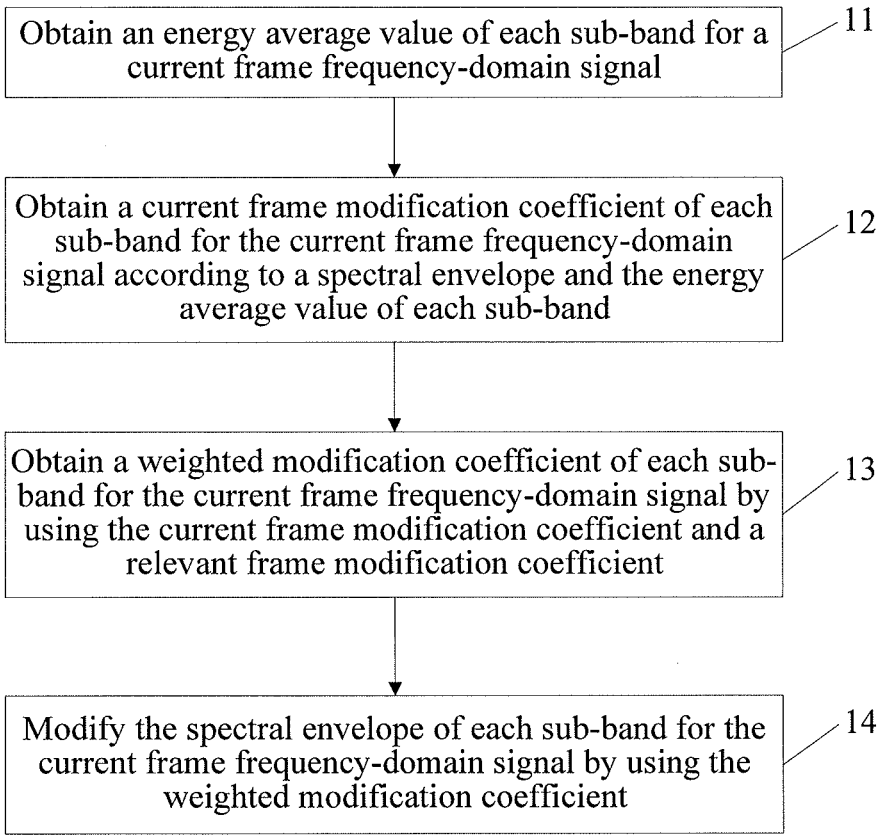
FIG. 1 is a flow chart of a method for processing a signal according to Embodiment 1 of the present invention.

In order to reduce noises in an output signal and improve the quality of the output signal, as shown in FIG. 1, Embodiment 1 of the present invention provides a method for processing a signal, which includes the following steps:

Step 11: Obtain an energy average value of each sub-band for a current frame frequency-domain signal.

In this step, time-frequency transform is performed on an input current frame time-domain signal, to obtain the current frame frequency-domain signal. For example, the corresponding current frame frequency-domain signal may be obtained from the current frame time-domain signal through methods such as Modified Discrete Cosine Transform (MDCT) or Fast Fourier Transform (FFT). Then, the energy average value of each sub-band is calculated. In the calculation of the energy average value of each sub-band, a method in the prior art may be employed, which is not described in detail herein again.

Step 12: Obtain a current frame modification coefficient of each sub-band for the current frame frequency-domain signal according to a spectral envelope and the energy average value of each sub-band.

The current frame modification coefficient may be obtained using any intra-frame post-processing method in the prior art, or set according to an empirical value.

Step 13: Obtain a weighted modification coefficient of each sub-band for the current frame frequency-domain signal by using the current frame modification coefficient and a relevant frame modification coefficient.

In this embodiment, the weighted modification coefficient is a weight sum of the current frame modification coefficient of the current frame of the current frame frequency-domain signal and a corresponding weighted modification coefficient of a sub-band for a relevant frame frequency-domain signal, for example, previous one or previous several frame frequency-domain signals, of the current frame frequency-domain signal. That is to say, the weighted modification coefficient is a comprehensive modification coefficient obtained by integrating the current frame modification coefficients of two frames of the frequency-domain signal. In addition, the weighted modification coefficient $\beta_c'[n]$ may be calculated according to Formula (1):

$$\beta_c'[n]=\mu*\beta_p[n]+\gamma*\beta_c[n] \quad (1),$$

in which $\beta_c'[n]$ represents a weighted modification coefficient, $\beta_c[n]$ represents a current frame modification coefficient of an $n^{th}$ sub-band for the current frame frequency-domain signal; $\beta_p[n]$ represents a corresponding weighted modification coefficient of a sub-band for a relevant frame frequency-domain signal of the current frame frequency-domain signal; and $\mu$ and $\gamma$ are respectively modification parameters, where $0<\mu<1$, $0<\gamma<1$, and $\mu+\gamma=1$.

Step 14: Modify the spectral envelope of each sub-band for the current frame frequency-domain signal by using the weighted modification coefficient.

This process may also be referred to as inter-frame smoothing processing performed on the current frame frequency-domain signal. In this step, the spectral envelope of each sub-band for the current frame frequency-domain signal is linearly transformed with the weighted modification coefficient $\beta_c'[n]$ as a transform factor as follows:

$$f'Env[n]=fEnv[n]*\beta_c'[n],$$

in which fEnv[n] represents an output spectral envelope of an $n^{th}$ sub-band for the current frame frequency-domain signal, $\beta_c'[n]$ represents a weighted modification coefficient, and f'Env[n] represents a modified output spectral envelope of the $n^{th}$ sub-band for the current frame frequency-domain signal.

It can be seen from the above process that, in the method for processing a signal according to Embodiment 1 of the present invention, the energy average value of each sub-band for the frequency-domain signal of the input signal is obtained, then the current frame modification coefficient of each sub-band for the current frame frequency-domain signal is obtained according to the spectral envelope and the energy average value of each sub-band, the weighted modification coefficient of each sub-band for the current frame frequency-domain signal is obtained by using the current frame modification coefficient and the relevant frame modification coefficient, and the spectral envelope of each sub-band for the current frame frequency-domain signal is modified by using the weighted modification coefficient.

As the weighted modification coefficient is employed to modify the spectral envelope of each sub-band for the current frame frequency-domain signal, inter-frame continuity of the frequency-domain signal is considered in the method according to Embodiment 1 of the present invention as compared with the prior art, so that the noises in the output signal are reduced, and the quality of the output signal is improved.

Figure 2:
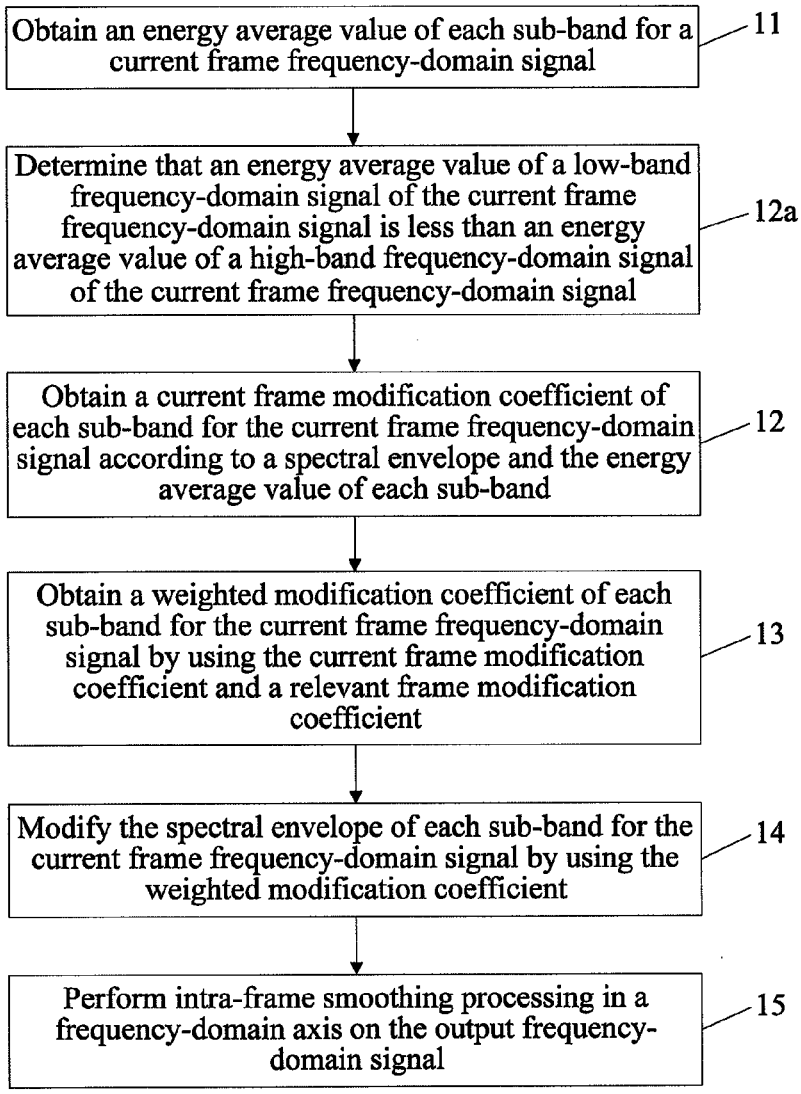
FIG. 2 is a specific flow chart of the method for processing a signal according to Embodiment 1 of the present invention.

In addition, in view of some frames requiring no intra-frame processing, as shown in FIG. 2, the method according to Embodiment 1 of the present invention may further include the following steps before step 12, so as to further alleviate the discontinuity phenomenon in the output signal and improve the quality of the output signal.

Step 12*a*: Determine that an energy average value of a low-band frequency-domain signal of the current frame frequency-domain signal is less than an energy average value of a high-band frequency-domain signal of the current frame frequency-domain signal.

This step may include the following process:

Step 121: Divide the current frame frequency-domain signal into a high-band frequency-domain signal and a low-band frequency-domain signal first, and calculate energy average values of the high-band frequency-domain signal and the low-band frequency-domain signal respectively. In the calculation of the energy average values of the high-band frequency-domain signal and the low-band frequency-domain signal, a method in the prior art may be employed, and the calculation process is not further described in detail herein again.

Step 122: Compare the energy average values of the high-band frequency-domain signal and the low-band frequency-domain signal, and determine magnitudes of the energy average values of the high-band frequency-domain signal and the low-band frequency-domain signal.

On this basis, the obtaining of the current frame modification coefficient of each sub-band for the current frame frequency-domain signal in step 12 may be implemented in the following manner:

In the process of obtaining the current frame modification coefficient of each sub-band for the current frame frequency-domain signal, taking an $n^{th}$ sub-band of the current frame frequency-domain signal as an example, it is assumed that $\beta_c[n]$ represents a current frame modification coefficient of the $n^{th}$ sub-band for the current frame frequency-domain signal, the current frame frequency-domain signal has N sub-bands in total, n is an integer and is set to be a value within the range of (0, N), and fEnv [n] represents a spectral envelope of the $n^{th}$ sub-band for the current frame frequency-domain signal. Therefore, the current frame modification coefficient $\beta_c[n]$ of the $n^{th}$ sub-band for the current frame frequency-domain signal may be obtained according to Formula (2):

$$\beta_c[n] = \begin{cases} \alpha_L & fEnv[n] < \alpha * \text{avrg} \\ \alpha_H & fEnv[n] > \delta * \text{avrg} \\ 1 & \text{others,} \end{cases} \quad (2)$$

in which $\alpha_L$ and $\alpha_H$ represent modification parameters, $0<\alpha_L<1$, $0<\alpha<1$, $1<\alpha_H<2$, $0<\delta<1$, and avrg represents an average value of a spectral envelope of a band to be modified.

It can be seen from Formula (2) that, in the process of obtaining the current frame modification coefficient of each sub-band for the current frame frequency-domain signal, if the spectral envelope of the $n^{th}$ sub-band for the current frame frequency-domain signal is less than a corresponding first spectral envelope threshold value $\alpha$*avrg, the spectral envelope of the sub-band is reduced, that is, $\beta_c[n]$ is set to be a smaller value $\alpha_H$. If the spectral envelope of the $n^{th}$ sub-band for the current frame frequency-domain signal is greater than a corresponding second spectral envelope threshold value $\delta$*avrg, the spectral envelope of the sub-band is increased, that is, $\beta_c[n]$ is set to be a larger value $\alpha_L$. Or otherwise, the spectral envelope of each sub-band for the current frame frequency-domain signal is kept unchanged.

In order to further improve the quality of the output signal and ensure the continuity of the output frequency-domain signal in a frequency-domain axis, as shown in FIG. 2, the method for processing a signal according to Embodiment 1 of the present invention may further include the following steps:

Step 15: Perform intra-frame smoothing processing in a frequency-domain axis on the output frequency-domain signal at a decoder.

In this step, the intra-frame smoothing processing may be performed on the output spectral envelope in the frequency-domain axis according to Formula (3):

$$\begin{cases} \text{spec}[i \cdot M + j] = \text{spec}[i \cdot M + j] \cdot fEnv[i] & i = 0,\ j = 0 \ldots M/2 - 1 \\ \text{spec}[i \cdot M + j] = \text{spec}[i \cdot M + j] \cdot (fEnv[i] \cdot (3/2 - j/M) + fEnv[i+1] \cdot (j/M - 1/2)) & i = 0 \ldots N-2,\ j = M/2 \ldots M-1 \\ \text{spec}[i \cdot M + j] = \text{spec}[i \cdot M + j] \cdot (fEnv[i-1] \cdot (1/2 - j/M) + fEnv[i] \cdot (1/2 + j/M)) & i = 1 \ldots N-1,\ j = 0 \ldots M/2 - 1 \\ \text{spec}[i \cdot M + j] = \text{spec}[i \cdot M + j] \cdot fEnv[i] & i = N-1,\ j = M/2 \ldots M \end{cases} \quad (3)$$

in which M is the number of elements in an $i^{th}$ sub-band, N is the number of sub-bands, i represents the $i^{th}$ sub-band, and j represents a $i^{th}$ element in the sub-band.

The method according to Embodiment 1 of the present invention can not only be applied at an encoder, but also be applied at a decoder, or be applied at the encoder and the decoder at the same time, or only be used to process a part of signals as described in the embodiment. Hereinafter, the implementation of the method according to Embodiment 1 of the present invention in different application scenarios is described in detail below with reference to Embodiments 2 to 5 respectively.

Embodiment 2

Figure 3:
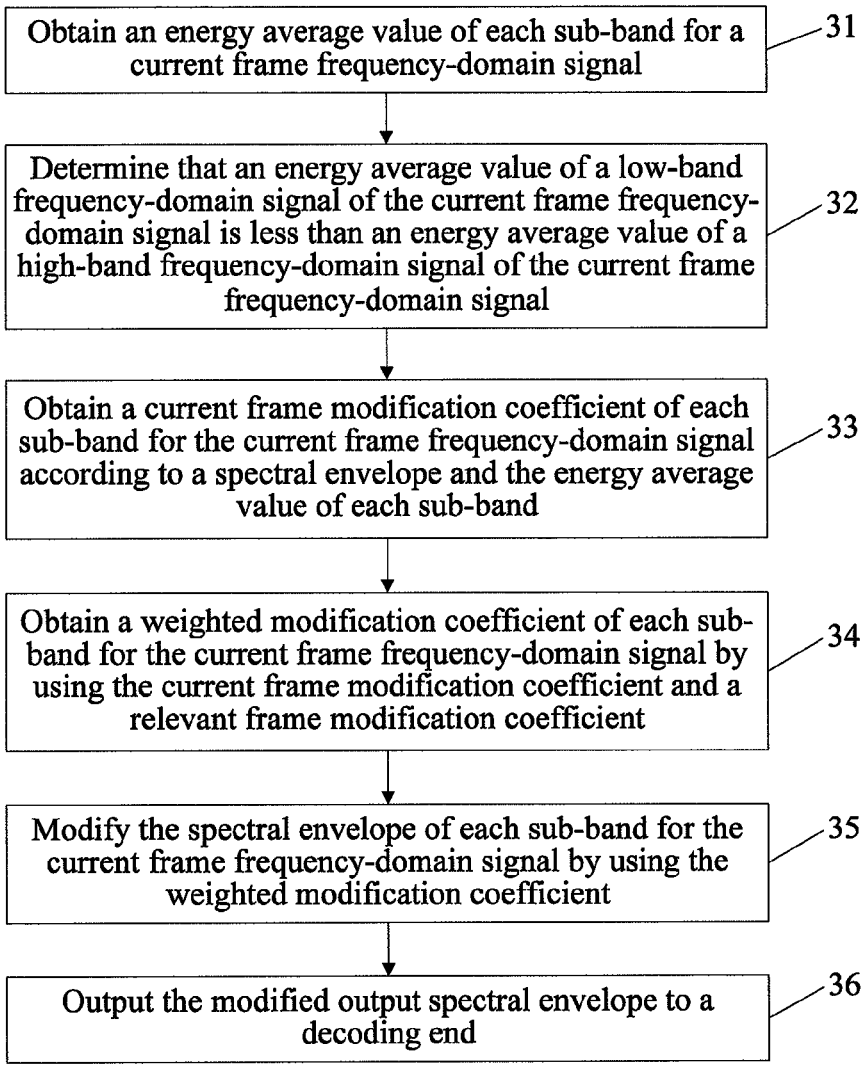
FIG. 3 is a flow chart of a method for processing a signal according to Embodiment 2 of the present invention.

As shown in FIG. 3, the method for processing a signal according to Embodiment 2 includes the following steps:

Step 31: Obtain an energy average value of each sub-band for a current frame frequency-domain signal.

Similar to the description in Embodiment 1, time-frequency transform is performed on an input current frame time-domain signal, to obtain the current frame frequency-domain signal. For example, the corresponding current frame frequency-domain signal may be obtained from the current frame time-domain signal through methods such as MDCT or FFT. Then, the energy average value of each sub-band is calculated.

Step 32: Determine that an energy average value of a low-band frequency-domain signal of the current frame frequency-domain signal is less than an energy average value of a high-band frequency-domain signal of the current frame frequency-domain signal.

In this process, following the manner as described in Embodiment 1, the current frame frequency-domain signal may be divided into a high-band frequency-domain signal and a low-band frequency-domain signal first, and energy average values of the high-band frequency-domain signal and the low-band frequency-domain signal are calculated respectively. Then, the energy average values of the high-band frequency-domain signal and the low-band frequency-domain signal are compared.

Step 33: Obtain a current frame modification coefficient of each sub-band for the current frame frequency-domain signal according to a spectral envelope and the energy average value of each sub-band. This process may be referred to as intra-frame pre-processing performed on the current frame frequency-domain signal at an encoder.

In this process, when the energy average value of the low-band frequency-domain signal is less than the energy average value of the high-band frequency-domain signal, the current frame modification coefficient of each sub-band for the current frame frequency-domain signal may be obtained in the following manner:

Taking an $n^{th}$ sub-band of the current frame frequency-domain signal as an example, a current frame modification coefficient $\beta_c[n]$ of the $n^{th}$ sub-band for the current frame frequency-domain signal may be calculated according to Formula (4):

$$\beta_c[n] = \begin{cases} 0.5 & fEnv[n] < 0.4 * \text{avrg} \\ 1.2 & fEnv[n] > 1.5 * \text{avrg} \\ 1 & \text{others} \end{cases} \quad (4)$$

In Formula (4), $\alpha_L$ is set to 0.5 in this embodiment, and $\alpha_H$ is set to 1.2 in this embodiment. The values of the two modification parameters may be empirically set or determined according to experiment. That is, if a spectral envelope of a current sub-band is fEnv[n]<0.4*avrg, $\beta_c[n]=0.5$; if fEnv[n]>1.5*avrg, $\beta_c[n]=1.2$; or otherwise, $\beta_c[n]=1.0$ that is to say, the spectral envelope of the $n^{th}$ sub-band for the current frame frequency-domain signal is kept unchanged.

In this step, some frames requiring no intra-frame pre-processing are considered, so that the discontinuity phenomenon in the output signal is further alleviated, and the quality of the output signal is improved.

Step 34: Obtain a weighted modification coefficient of each sub-band for the current frame frequency-domain signal by using the current frame modification coefficient and a relevant frame modification coefficient.

In this step, a weighted modification coefficient $\beta_c'[n]$ of the $n^{th}$ sub-band for the current frame frequency-domain signal may be obtained according to Formula (1) in Embodiment 1, and modification parameters $\mu$ and $\gamma$ are set to 0.5 respectively, so that the weighted modification coefficient $\beta_c'[n]$ in Embodiment 2 is calculated. In Embodiment 2, an initial value of a corresponding weighted modification coefficient of a sub-band for a previous frame is set to 1.

Step 35: Modify the spectral envelope of each sub-band for the current frame frequency-domain signal by using the weighted modification coefficient $\beta_c'[n]$, that is, the spectral envelope adjusted by the weighted modification coefficient $\beta_c'[n]$ is used as an output spectral envelope of the $n^{th}$ sub-band, that is:

$$f'Env[n]=fEnv[n]*\beta_c'[n],$$

in which fEnv[n] represents an output spectral envelope of the $n^{th}$ sub-band for the current frame frequency-domain signal, $\beta_c'[n]$ represents a weighted modification coefficient, and f'Env[n] represents a modified output spectral envelope of the $n^{th}$ sub-band for the current frame frequency-domain signal.

Step 36: Output the modified output spectral envelope to a decoder.

Correspondingly, a spectral envelope is obtained first by decoding at the decoder, then the spectral envelope and a frequency-domain excitation signal together generate a frequency-domain signal, and frequency-time transform is performed on the frequency-domain signal to obtain a time-domain signal.

It can be seen from the foregoing process that, in the method for processing a signal according to Embodiment 2 of the present invention, the spectral envelope of each sub-band for the current frame frequency-domain signal is modified by using the weighted modification coefficient, and therefore, inter-frame continuity of the frequency-domain signal is considered in the method according to this embodiment of the present invention as compared with the prior art, so that the noises in the output signal are reduced, and the quality of the output signal is improved.

Embodiment 3

Figure 4:
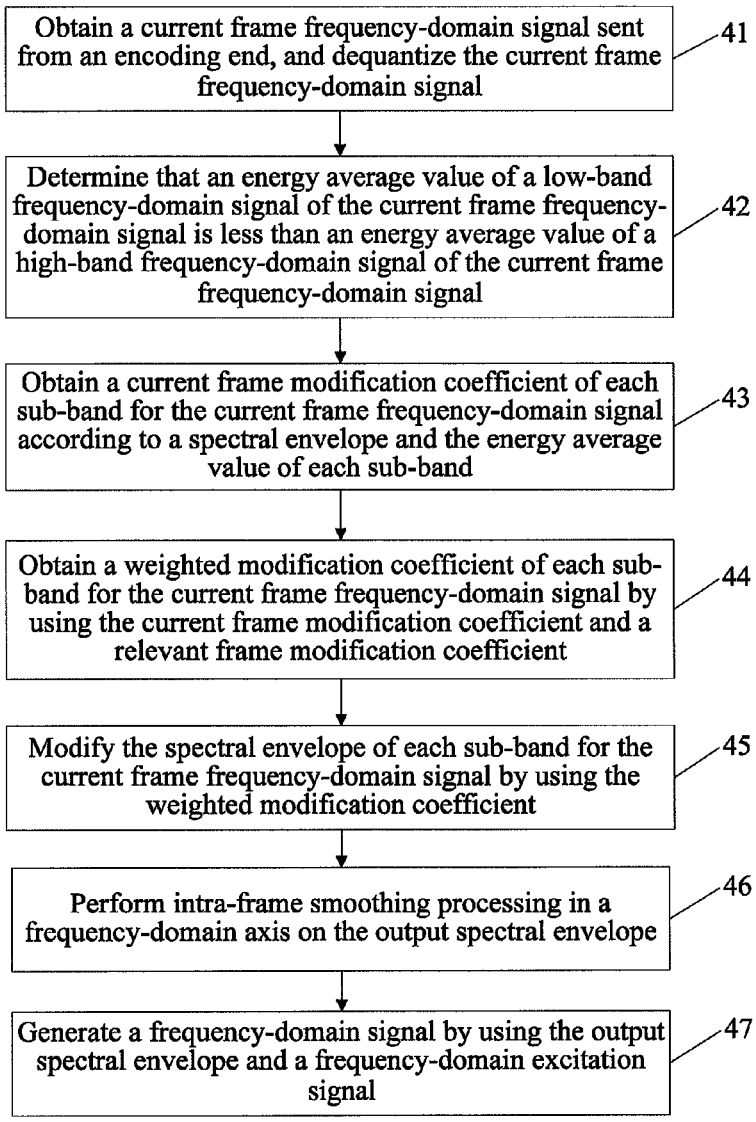
FIG. 4 is a flow chart of a method for processing a signal according to Embodiment 3 of the present invention.

In the method for processing a signal according to Embodiment 3, time-frequency transform is performed on an input current frame time-domain signal first at an encoder, to obtain a corresponding current frame frequency-domain signal. Then, the current frame frequency-domain signal is quantized and sent to a decoder. As shown in FIG. 4, the method for processing a signal according to Embodiment 3 of the present invention includes the following steps:

Step 41: Obtain a current frame frequency-domain signal sent from an encoder, and dequantize the current frame frequency-domain signal to obtain a decoded current frame frequency-domain signal. This process is the same as that in the prior art, and is not described in detail herein again.

Step 42: Determine that an energy average value of a low-band frequency-domain signal of the current frame frequency-domain signal is less than an energy average value of a high-band frequency-domain signal of the current frame frequency-domain signal.

In this process, following the manner as described in Embodiment 1 or 2, the current frame frequency-domain signal may be divided into a high-band frequency-domain signal and a low-band frequency-domain signal first, and energy average values of the high-band frequency-domain signal and the low-band frequency-domain signal are calculated respectively. Then, the energy average values of the high-band frequency-domain signal and the low-band frequency-domain signal are compared.

Step 43: Obtain a current frame modification coefficient of each sub-band for the current frame frequency-domain signal according to a spectral envelope and the energy average value of each sub-band. This process may be referred to as intra-frame post-processing performed on the decoded current frame frequency-domain signal at a decoder.

In this process, when the energy average value of the low-band frequency-domain signal is less than the energy average value of the high-band frequency-domain signal, the current frame modification coefficient of each sub-band for the current frame frequency-domain signal may be obtained in the following manner:

Taking an $n^{th}$ sub-band of the current frame frequency-domain signal as an example, a current frame modification coefficient $\beta_c[n]$ of the $n^{th}$ sub-band for the current frame frequency-domain signal may be calculated according to Formula (5):

$$\beta_c[n] = \begin{cases} 0.5 & fEnv[n] < 0.4 * \text{avrg} \\ 1.2 & fEnv[n] > 1.5 * \text{avrg} \\ 1 & \text{others} \end{cases} \quad (5)$$

In Formula (5), $\alpha_L$ is set to 0.5 in this embodiment, and $\alpha_H$ is set to 1.2 in this embodiment. The values of the two modification parameters are empirical values, or may be determined according to experiment.

That is, if a spectral envelope of the $n^{th}$ sub-band fEnv[n]<0.4*avrg, $\beta_c[n]=0.5$; if fEnv[n]>1.5*avrg, $\beta_c[n]=1.2$; or otherwise, $\beta_c[n]=1.0$, that is to say, the spectral envelope of the $n^{th}$ sub-band for the current frame frequency-domain signal is kept unchanged.

In this step, some frames requiring no intra-frame post-processing are considered, so that the discontinuity phenomenon in the output signal is further alleviated, and the quality of the output signal is improved.

Step 44: Obtain a weighted modification coefficient of each sub-band for the current frame frequency-domain signal by using the current frame modification coefficient and a relevant frame modification coefficient.

In this step, a weighted modification coefficient $\beta_c'[n]$ of the $n^{th}$ sub-band for the current frame frequency-domain signal is obtained first. $\beta_c'[n]$ may be obtained according to Formula (1) in Embodiment 1, and modification parameters $\mu$ and $\gamma$ are set to be a value of 0.5 respectively, so that the weighted modification coefficient $\beta_c'[n]$ in Embodiment 3 is calculated. In Embodiment 3, an initial value of a corresponding weighted modification coefficient of a sub-band for a previous frame is set to 1.

Step 45: Modify the spectral envelope of each sub-band for the current frame frequency-domain signal by using the weighted modification coefficient $\beta_c'[n]$, that is, a process of inter-frame smoothing processing is performed on the current frame frequency-domain signal. Therefore, the spectral envelope modified with the weighted modification coefficient $\beta_c'[n]$ is used as an output spectral envelope of the $n^{th}$ sub-band, that is:

$$f'Env[n]=fEnv[n]*\beta_c'[n],$$

in which fEnv[n] represents an output spectral envelope of the $n^{th}$ sub-band for the current frame frequency-domain signal, $\beta_c'[n]$ represents a weighted modification coefficient, and f'Env[n] represents a modified output spectral envelope of the $n^{th}$ sub-band for the current frame frequency-domain signal.

Step 46: Perform intra-frame smoothing processing in a frequency-domain axis on the output spectral envelope. This step may be performed by using the method of step 15 in Embodiment 1.

Step 47: Generate a frequency-domain signal using the output spectral envelope and a frequency-domain excitation signal, and perform frequency-time transform on the frequency-domain signal to obtain a time-domain signal.

It can be seen from the foregoing process that, in the method for processing a signal according to Embodiment 3 of the present invention, the spectral envelope of each sub-band for the current frame frequency-domain signal is modified by using the weighted modification coefficient, and therefore, inter-frame continuity of the frequency-domain signal is considered in the method according to this embodiment of the present invention as compared with the prior art, so that the noises in the output signal are reduced, and the quality of the output signal is improved.

In addition, in the method according to Embodiment 3 of the present invention, intra-frame smoothing processing in the frequency-domain axis is performed on the frequency-domain signal, so that inter-frame continuity in the frequency-domain axis is ensured, and the quality of the output signal is further improved.

Embodiment 4

In a method for processing a signal according to Embodiment 4, an input current frame time-domain signal is divided into a low-band signal and a high-band signal at an encoder first. The low-band signal is encoded through ADPCM and sent to a decoder, and the high-band signal is transformed into a frequency-domain signal through time-frequency transform and sent to the decoder.

At the decoder, the received low-band signal is decoded through ADPCM first, to obtain a time-domain signal of the low-band signal, and then time-frequency transform is performed on the low-band time-domain signal, to obtain a frequency-domain signal of the low-band time-domain signal. Next, intra-frame post-processing and inter-frame smoothing processing are performed on the low-band frequency-domain signal according to the manners of intra-frame post-processing and inter-frame smoothing processing described in Embodiment 1 or 3.

Different from Embodiment 1 or 3, when it is judged whether intra-frame post-processing and inter-frame smoothing processing need to be performed on a current sub-band for a current frame of the low-band frequency-domain signal, the low band and the high band for calculating the energy of the low band and the high band are defined based on the whole band, because only the whole band can accurately reflect the property of an input signal. Finally, frequency-time transform is performed on the low-band frequency-domain signal after the intra-frame post-processing and inter-frame smoothing processing, to obtain a low-band time-domain signal.

At the decoder, high-band decoding is performed on the received high-band frequency-domain signal, and then frequency-time transform is performed on the decoded high-band signal to obtain a high-band time-domain signal.

Finally, the low-band time-domain signal and the high-band time-domain signal are combined into an output signal.

In the method according to Embodiment 4 of the present invention, inter-frame continuity of the frequency-domain signal is considered by performing the intra-frame post-processing and the inter-frame smoothing processing on the low-band frequency-domain signal, so that the noises in the output signal are reduced, and the quality of the output signal is improved.

Embodiment 5

In Embodiment 5, following the method as described in Embodiment 2, intra-frame pre-processing and inter-frame smoothing processing are performed on an input current frame frequency-domain signal at an encoder, and then following the method as described in Embodiment 3, intra-frame post-processing and inter-frame smoothing processing are performed on the input current frame frequency-domain signal at a decoder. Using the method for processing a signal according to Embodiment 5, the noises in the output signal can also be reduced, so as to improve the quality of the output signal.

Persons of ordinary skill in the art should understand that, all or a part of the processes in the method according to the embodiments may be implemented by a computer program instructing relevant hardware. The program may be stored in a computer-readable storage medium. When the program is executed, the processes of the method according to the embodiments of the present invention are performed. The storage medium may be a magnetic disk, a compact disk, a read-only memory (ROM), or a random access memory (RAM).

Embodiment 6

Figure 5:
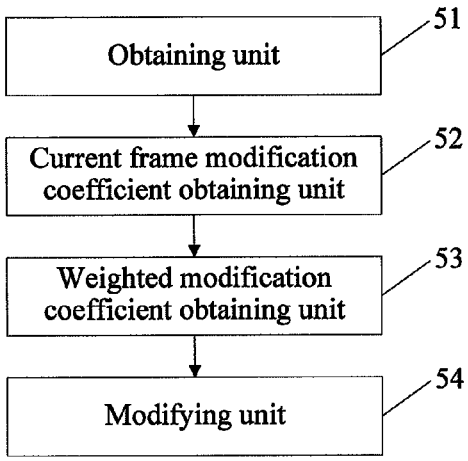
FIG. 5 is a schematic view of an apparatus for processing a signal according to Embodiment 6 of the present invention.

Embodiment 6 of the present invention further provides an apparatus for processing a signal, which includes an obtaining unit 51, a current frame modification coefficient obtaining unit 52, a weighted modification coefficient obtaining unit 53, and a modifying unit 54, as shown in FIG. 5. The signal obtaining unit 51 is configured to obtain an energy average value of each sub-band for a current frame frequency-domain signal; the current frame modification coefficient obtaining unit 52 is configured to obtain a current frame modification coefficient of each sub-band for the current frame frequency-domain signal according to a spectral envelope and the energy average value of each sub-band; the weighted modification coefficient obtaining unit 53 is configured to obtain a weighted modification coefficient of each sub-band for the current frame frequency-domain signal by using the current frame modification coefficient and a relevant frame modification coefficient; and the modification unit 54 is configured to modify the spectral envelope of each sub-band for the current frame frequency-domain signal by using the weighted modification coefficient.

Compared with the prior art, the apparatus for processing a signal according to the embodiment of the present invention considers the inter-frame continuity of the frequency-domain signal, so that the noises in the output signal are reduced, and the quality of the output signal is improved.

Figure 6:
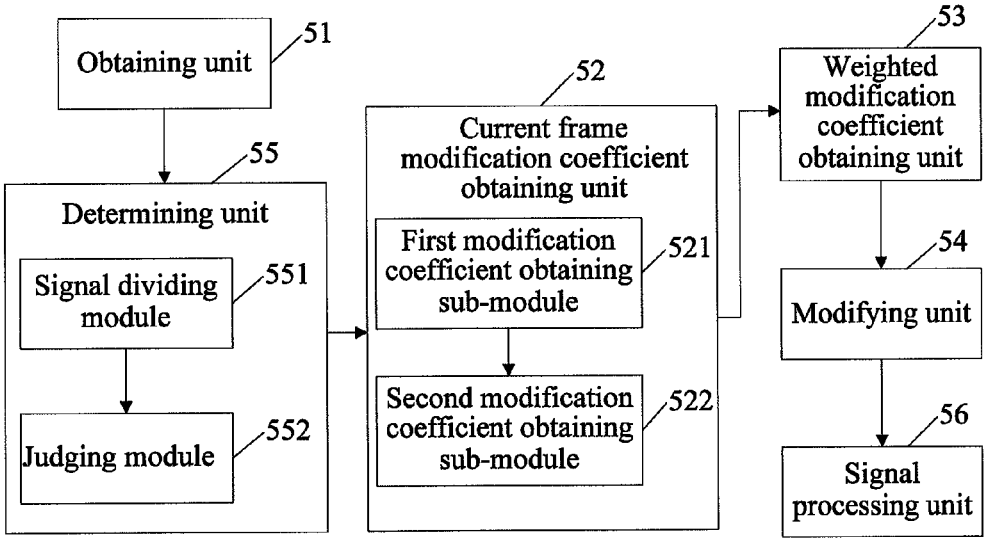
FIG. 6 is a structural view of the apparatus for processing a signal according to Embodiment 6 of the present invention.

As shown in FIG. 6, in order to further alleviate the discontinuity phenomenon in the output signal and improve the quality of the output signal, the apparatus may further include a determining unit 55, configured to determine that an energy average value of a low-band frequency-domain signal of the current frame frequency-domain signal is less than an energy average value of a high-band frequency-domain signal of the current frame frequency-domain signal. Specifically, the determining unit 55 includes a signal dividing module 551, configured to divide the current frame frequency-domain signal into the high-band frequency-domain signal and the low-band frequency-domain signal; a judging module 552, configured to judge magnitudes of the energy average values of the low-band frequency-domain signal of the current frame frequency-domain signal and the high-band frequency-domain signal of the current frame frequency-domain signal.

As shown in FIG. 6, the current frame modification coefficient obtaining unit 52 may include a first modification coefficient obtaining sub-module 521 and a second modification coefficient obtaining sub-module 522.

The first modification coefficient obtaining sub-module 521 is configured to set the current frame modification coefficient to be a first modification coefficient, when the judging module 552 judges that the energy average value of the low-band frequency-domain signal is less than the energy average value of the high-band frequency-domain signal, and the spectral envelope of each sub-band for the current frame frequency-domain signal is less than a corresponding first spectral envelope threshold value; and the second modification coefficient obtaining sub-module 522 is configured to set the current frame modification coefficient to be a second modification coefficient, when the judging module 552 judges that the energy average value of the low-band frequency-domain signal is less than the energy average value of the high-band frequency-domain signal, and the spectral envelope of each sub-band for the current frame frequency-domain signal is higher than a corresponding second spectral envelope threshold value, in which the first modification coefficient is set to be $\phi$ ranging in (0, 1); and the second modification coefficient is set to be $\beta$ ranging in (1, 2).

In order to further improve the quality of the output signal and ensure the continuity of the output signal in a frequency-domain axis, as shown in FIG. 6, the apparatus may further include a signal processing unit 56, configured to perform intra-frame smoothing processing in the frequency-domain axis on the output frequency-domain signal.

To sum up, in the method and the apparatus for processing a signal according to the embodiments of the present invention, the weighted modification coefficient is employed to modify the spectral envelope of each sub-band for the current frame frequency-domain signal, and inter-frame continuity of the frequency-domain signal is considered in the method and the apparatus according to the embodiments of the present invention as compared with the prior art, so that the noises in the output signal are reduced, and the quality of the output signal is improved.

Embodiment 7

Embodiment 7 of the present invention provides a method for processing a signal, which includes the following steps:

Step 71: Obtain an amplitude of at least one frequency-domain coefficient of a current frame frequency-domain signal.

In this step, time-frequency transform is performed on an input current frame time-domain signal, to obtain the current frame frequency-domain signal. For example, the corresponding current frame frequency-domain signal may be obtained from the current frame time-domain signal through methods such as MDCT or FFT. Then, the amplitude of the at least one frequency-domain coefficient of the current frame frequency-domain signal is calculated. In the calculation of the amplitude of the frequency-domain coefficient, a method in the prior art may be employed, which is not described in detail herein again.

Step 72: Compare the amplitude of the at least one frequency-domain coefficient with an amplitude average value of the frequency-domain coefficients, and obtain at least one current frame modification coefficient corresponding to the at least one frequency-domain coefficient, where the amplitude average value of the frequency-domain coefficients is an amplitude average value of at least two consecutive frequency-domain coefficients in the current frame frequency-domain signal, and the at least two consecutive frequency-domain coefficients include the least one current frequency-domain coefficient The at least one current frame modification coefficient may be obtained through any intra-frame post-processing method in the prior art, or set according to an empirical value.

Step 73: Obtain a weighted modification coefficient of the current frame frequency-domain signal corresponding to the at least one frequency-domain coefficient by using the at least one current frame modification coefficient and a relevant frame modification coefficient.

In this embodiment, the weighted modification coefficient is a weight sum of the corresponding current frame modification coefficient of the current frame of the current frame frequency-domain signal and a corresponding weighted modification coefficient of a relevant frame frequency-domain signal, for example, previous one or previous several frame frequency-domain signals, of the current frame frequency-domain signal. That is to say, the weighted modification coefficient is a comprehensive modification coefficient obtained by integrating the current frame modification coefficients of two frames of the frequency-domain signal. In addition, the weighted modification coefficient $\beta_c'[n]$ may be calculated according to Formula (5):

$$\beta_c'[n]=\mu*\beta_p[n]\gamma*\beta_c[n] \quad (5),$$

in which $\beta_c'[n]$ represents a weighted modification coefficient, $\beta_c[n]$ represents an $n^{th}$ current frame modification coefficient of the current frame frequency-domain signal; $\beta_p[n]$ represents a corresponding weighted modification coefficient of a sub-band for a relevant frame frequency-domain signal of the current frame frequency-domain signal; and $\mu$ and $\gamma$ are respectively modification parameters, where $0<\mu<1$, $0<\gamma<1$, and $\mu+\gamma=1$.

Step 74: Modify the corresponding at least one frequency-domain coefficient of the current frame frequency-domain signal by using the weighted modification coefficient.

This process may also be referred to as inter-frame smoothing processing performed on the current frame frequency-domain signal. In this step, each frequency-domain coefficient of the current frame frequency-domain signal is linearly transformed with the weighted modification coefficient $\beta_c'[n]$ as a transform factor as follows:

$$f'Env[n]=fEnv[n]*\beta_c'[n],$$

in which fEnv[n] represents an $n^{th}$ frequency-domain coefficient of the current frame frequency-domain signal, $\beta_c'[n]$ represents a weighted modification coefficient, and f'Env[n] represents a modified $n^{th}$ frequency-domain coefficient of the current frame frequency-domain signal.

It can be seen from the above process that, in the method for processing a signal according to Embodiment 7 of the present invention, the amplitude of the at least one frequency-domain coefficient of the current frame frequency-domain signal is obtained first; then, the amplitude of the at least one frequency-domain coefficient is compared with the amplitude average value of the frequency-domain coefficients of the current frame frequency-domain signal, to obtain the at least one current frame modification coefficient corresponding to the at least one frequency-domain coefficient; the weighted modification coefficient of the current frame frequency-domain signal corresponding to the at least one frequency-domain coefficient is obtained by using the at least one current frame modification coefficient and the relevant frame modification coefficient; and the at least one frequency-domain coefficient of the current frame frequency-domain signal is modified by using the weighted modification coefficient.

As the weighted modification coefficient is used to modify the frequency-domain coefficient of the current frame frequency-domain signal, inter-frame continuity of the frequency-domain signal is considered in the method according to Embodiment 7 of the present invention as compared with the prior art, so that the noises in the output signal are reduced, and the quality of the output signal is improved.

In addition, in view of some frames requiring no intra-frame processing, the method according to Embodiment 7 of the present invention may further include the following steps, so as to further alleviate the discontinuity phenomenon in the output signal, and improve the quality of the output signal.

Step 72*a*: Determine that an energy average value of a low-band frequency-domain signal of the current frame frequency-domain signal is less than an energy average value of a high-band frequency-domain signal of the current frame frequency-domain signal.

This step may include the following process:

Step 721: Divide the current frame frequency-domain signal into a high-band frequency-domain signal and a low-band frequency-domain signal first, and calculate energy average values of the high-band frequency-domain signal and the low-band frequency-domain signal respectively. In the calculation of the energy average values of the high-band frequency-domain signal and the low-band frequency-domain signal, a method in the prior art may be employed, and the calculation process is not further described in detail herein again.

Step 722: Compare the energy average values of the high-band frequency-domain signal and the low-band frequency-domain signal, and determine magnitudes of the energy average values of the high-band frequency-domain signal and the low-band frequency-domain signal are determined.

On this basis, the obtaining of the current frame modification coefficient of each sub-band for the current frame frequency-domain signal in step 72 may be implemented in the following manner:

In the process of obtaining the current frame modification coefficient of the current frame frequency-domain signal, it is assumed that $\beta_c[n]$ represents an $n^{th}$ current frame modification coefficient of the current frame frequency-domain signal, the current frame frequency-domain signal has N frequency-domain coefficients in total, and each frequency-domain coefficient is corresponding to one current frame modification coefficient and one weighted modification coefficient. n is an integer and is set to be a value in the range of (0, N), and fEnv [n] represents an $n^{th}$ frequency-domain coefficient of the current frame frequency-domain signal. Therefore, the $n^{th}$ current frame modification coefficient $\beta_c[n]$ of the current frame frequency-domain signal may be obtained according to Formula (6):

$$\beta_c[n] = \begin{cases} \alpha_L & |fEnv[n]| < \alpha * \text{avrg} \\ \alpha_H & |fEnv[n]| > \delta * \text{avrg} \\ 1 & \text{others,} \end{cases} \tag{6}$$

in which $\alpha_L$ and $\alpha_H$ represent modification parameters, $0<\alpha_L<1$, $0<\alpha<1$, $1<\alpha_H<2$, $0<\delta<1$, and avrg represents an amplitude average value of frequency-domain coefficients to be modified.

It can be seen from Formula (6) that, in the process of obtaining each current frame modification coefficient of the current frame frequency-domain signal, if the amplitude of the $n^{th}$ frequency-domain coefficient of the current frame frequency-domain signal is less than a corresponding first frequency-domain coefficient threshold value $\alpha$*avrg, the corresponding frequency-domain coefficient is reduced, that is, $\beta_c[n]$ is set to be a smaller value $\alpha_L$. If the amplitude of the $n^{th}$ frequency-domain coefficient of the current frame frequency-domain signal is greater than a corresponding second frequency-domain coefficient threshold value $\delta$*avrg, the corresponding frequency-domain coefficient is increased, that is, $\beta_c[n]$ is set to be a larger value $\alpha_H$. Or otherwise, each frequency-domain coefficient of the current frame frequency-domain signal is kept unchanged.

In order to further improve the quality of the output signal and ensure the continuity of the output frequency-domain signal in a frequency-domain axis, the method for processing a signal according to Embodiment 7 of the present invention may further include the following steps.

Step 75: Perform intra-frame smoothing processing in a frequency-domain axis on the modified frequency-domain signal at a decoder.

The method according to Embodiment 7 of the present invention can not only be applied at an encoder, but also be applied at a decoder, or be applied at the encoder and the decoder at the same time, or only be used to process a part of signals as described in the embodiment.

The methods according to Embodiments 1 to 5 of the present invention are implemented based on the spectral envelope when the number of the frequency-domain coefficients in each sub-band of the frequency-domain signal is greater than 1. The method according to Embodiment 7 of the present invention is implemented based on the frequency-domain coefficient when the number of the frequency-domain coefficients in each sub-band is 1, and in this case, the method is implemented by using the spectrum coefficient in the band as a frequency point without considering the concept of the sub-band in the modification process.

Embodiments 8 to 11

Correspondingly, the implementation of the method according to Embodiment 7 in different application scenario is described with reference to Embodiments 2 to 5, and the difference lies in that Embodiments 8 to 11 are implemented based on the frequency-domain coefficient, that is, the number of the frequency-domain coefficients in each sub-band is 1.

Embodiment 12

Embodiment 12 of the present invention further provides an apparatus for processing a signal, which includes an obtaining unit, a current frame modification coefficient obtaining unit, a weighted modification coefficient obtaining unit, and a modifying unit.

The obtaining unit is configured to obtain an amplitude of at least one frequency-domain coefficient of a current frame frequency-domain signal; the current frame modification coefficient obtaining unit is configured to compare the amplitude of the at least one frequency-domain coefficient with an amplitude average value of the frequency-domain coefficients, and obtain at least one current frame modification coefficient corresponding to the at least one frequency-domain coefficient, in which the amplitude average value of the frequency-domain coefficients is an amplitude average value of at least two consecutive frequency-domain coefficients in the current frame frequency-domain signal, and the at least two consecutive frequency-domain coefficients include the least one current frequency-domain coefficient; the weighted modification coefficient obtaining unit is configured to obtain a weighted modification coefficient of the current frame frequency-domain signal corresponding to the at least one frequency-domain coefficient by using the at least one current frame modification coefficient and a relevant frame modification coefficient; and the modifying unit is configured to modify the corresponding at least one frequency-domain coefficient of the current frame frequency-domain signal by using the weighted modification coefficient.

Compared with the prior art, the apparatus for processing a signal according to the embodiment of the present invention considers the inter-frame continuity of the frequency-domain signal, so that the noises in the output signal are reduced, and the quality of the output signal is improved.

In order to further alleviate the discontinuity phenomenon in the output signal and improve the quality of the output signal, the apparatus may further include a determining unit, a signal dividing module, and a judging module. The determining unit is configured to determine that an energy average value of a low-band frequency-domain signal of the current frame frequency-domain signal is less than an energy average value of a high-band frequency-domain signal of the current frame frequency-domain signal; the signal dividing module is configured to divide the current frame frequency-domain signal into the high-band frequency-domain signal and the low-band frequency-domain signal; and the judging module is configured to judge magnitudes of the energy average values of the low-band frequency-domain signal of the current frame frequency-domain signal and the high-band frequency-domain signal of the current frame frequency-domain signal.

The weighted modification coefficient obtaining unit may include a first modification coefficient obtaining sub-module and a second modification coefficient obtaining sub-module. The first modification coefficient obtaining sub-module is configured to set the current frame modification coefficient to be a first modification coefficient, if the amplitude is less than a first frequency-domain coefficient threshold value determined according to the amplitude average value, when the energy average value of the low-band frequency-domain signal is less than the energy average value of the high-band frequency-domain signal; and the second modification coefficient obtaining sub-module is configured to set the current frame modification coefficient to be a second modification coefficient, if the amplitude of the frequency-domain coefficient of the current frame frequency-domain signal is higher than a second frequency-domain coefficient threshold value determined according to the amplitude average value, when the energy average value of the low-band frequency-domain signal is less than the energy average value of the high-band frequency-domain signal, in which the first modification coefficient is set to be $\phi$ ranging in (0, 1); and the second modification coefficient is set to be $\beta$ ranging in (1, 2).

In order to further improve the quality of the output signal and ensure the continuity of the output signal in a frequency-domain axis, the apparatus may further include a signal processing unit, configured to perform intra-frame smoothing processing in the frequency-domain axis on the output frequency-domain signal after the corresponding at least one frequency-domain coefficient of the current frame frequency-domain signal is modified.

To sum up, in the method and the apparatus for processing a signal according to the embodiment of the present invention, the energy average value of each sub-band for the frequency-domain signal of the input signal is obtained first, then the current frame modification coefficient of each sub-band for the current frame frequency-domain signal is obtained according to the spectral envelope and the energy average value of each sub-band, the weighted modification coefficient of each sub-band for the current frame frequency-domain signal is obtained by using the current frame modification coefficient and the relevant frame modification coefficient, and the spectral envelope of each sub-band for the current frame frequency-domain signal is modified by using the weighted modification coefficient.

When the number of the frequency-domain coefficients in a sub-band is greater than 1, the embodiments of the present invention are implemented based on the spectral envelope, and when the number of the frequency-domain coefficients in a sub-band is 1, the embodiments of the present invention are implemented based on the frequency-domain coefficient, where the amplitude of the at least one frequency-domain coefficient of the current frame frequency-domain signal is obtained first; the amplitude of the at least one frequency-domain coefficient is compared with the amplitude average value of the frequency-domain coefficients of the current frame frequency-domain signal, to obtain the at least one current frame modification coefficient corresponding to the at least one frequency-domain coefficient; the weighted modification coefficient of the current frame frequency-domain signal corresponding to the at least one frequency-domain coefficient is obtained by using the at least one current frame modification coefficient and the relevant frame modification coefficient; and the corresponding at least one frequency-domain coefficient of the current frame frequency-domain signal is modified by using the weighted modification coefficient.

As the weighted modification coefficient is used to modify the spectral envelope of each sub-band for the current frame frequency-domain signal or the frequency-domain coefficient of the current frame frequency-domain signal, inter-frame continuity of the frequency-domain signal is considered in the method and the apparatus according to the embodiments of the present invention as compared with the prior art, so that the noises in the output signal are reduced, and the quality of the output signal is improved.

The above are merely specific embodiments of the present invention. However, the scope of the present invention is not limited thereto. Changes or replacements readily apparent to persons skilled in the art within the technical scope of the present invention shall fall within the scope of the present invention as defined by the appended claims.

What is claimed is:

1. A method for processing a signal, comprising:

obtaining an energy average value of each sub-band for a current frame frequency-domain signal;

obtaining a current frame modification coefficient of each sub-band for the current frame frequency-domain signal according to a spectral envelope and the energy average value of each sub-band;

obtaining a weighted modification coefficient of each sub-band for the current frame frequency-domain signal by using the current frame modification coefficient and a relevant frame modification coefficient, wherein the relevant frame modification coefficient comprises a modification coefficient of a sub-band for one or more previous frame frequency-domain signals; and modifying the spectral envelope of each sub-band for the current frame frequency-domain signal by using the weighted modification coefficient.

2. The method for processing a signal according to claim 1, wherein before obtaining the current frame modification coefficient of each sub-band for the current frame frequency-domain signal according to the spectral envelope and the energy average value of each sub-band, the method further comprises determining that an energy average value of a low-band frequency-domain signal of the current frame frequency-domain signal is less than an energy average value of a high-band frequency-domain signal of the current frame frequency-domain signal.

3. The method for processing a signal according to claim 2, wherein obtaining the current frame modification coefficient of each sub-band for the current frame frequency-domain signal according to the spectral envelope and the energy average value of each sub-band comprises:

setting the current frame modification coefficient to be a first modification coefficient, if the spectral envelope of each sub-band for the current frame frequency-domain signal is less than a corresponding first spectral envelope threshold value, when the energy average value of the low-band frequency-domain signal is less than the energy average value of the high-band frequency-domain signal; and setting the current frame modification coefficient to be a second modification coefficient, if the spectral envelope of each sub-band for the current frame frequency-domain signal is greater than a corresponding second spectral envelope threshold value, when the energy average value of the low-band frequency-domain signal is less than the energy average value of the high-band frequency-domain signal, wherein the first modification coefficient is set to be $\phi$ ranging in (0, 1), and wherein the second modification coefficient is set to be $\beta$ ranging in (1, 2).

4. The method for processing a signal according to claim 1, wherein obtaining the weighted modification coefficient of each sub-band for the current frame frequency-domain signal by using the current frame modification coefficient and a relevant frame modification coefficient comprises performing a weight sum operation on the current frame modification coefficient and the relevant frame modification coefficient, and using an operation result as the weighted modification coefficient of each sub-band for the current frame frequency-domain signal.

5. The method for processing a signal according to claim 1, wherein modifying the spectral envelope of each sub-band for the current frame frequency-domain signal by using the weighted modification coefficient comprises linearly transforming the spectral envelope of each sub-band for the current frame frequency-domain signal with the weighted modification coefficient as a transform factor.

6. An apparatus for processing a signal, comprising:

an obtaining unit configured to obtain an energy average value of each sub-band for a current frame frequency-domain signal;

a current frame modification coefficient obtaining unit configured to obtain a current frame modification coefficient of each sub-band for the current frame frequency-domain signal according to a spectral envelope and the energy average value of each sub-band;

a weighted modification coefficient obtaining unit configured to obtain a weighted modification coefficient of each sub-band for the current frame frequency-domain signal by using the current frame modification coefficient and a relevant frame modification coefficient, wherein the relevant frame modification coefficient comprises a modification coefficient of a sub-band for one or more previous frame frequency-domain signals; and a modifying unit configured to use a processor to modify the spectral envelope of each sub-band for the current frame frequency-domain signal by using the weighted modification coefficient.

7. The apparatus for processing a signal according to claim 6, further comprising a determining unit configured to determine that an energy average value of a low-band frequency-domain signal of the current frame frequency-domain signal is less than an energy average value of a high-band frequency-domain signal of the current frame frequency-domain signal.

8. The apparatus for processing a signal according to claim 7, wherein the determining unit comprises:

a signal dividing module configured to divide the current frame frequency-domain signal into the high-band frequency-domain signal and the low-band frequency-domain signal; and a judging module configured to judge magnitudes of the energy average values of the low-band frequency-domain signal of the current frame frequency-domain signal and the high-band frequency-domain signal of the current frame frequency-domain signal.

9. The apparatus for processing a signal according to claim 8, wherein the weighted modification coefficient obtaining unit comprises:

a first modification coefficient obtaining sub-module configured to set the current frame modification coefficient to be a first modification coefficient, if the spectral envelope of each sub-band for the current frame frequency-domain signal is less than a corresponding first spectral envelope threshold value, when the energy average value of the low-band frequency-domain signal is less than the energy average value of the high-band frequency-domain signal; and a second modification coefficient obtaining sub-module configured to set the current frame modification coefficient to be a second modification coefficient, if the spectral envelope of each sub-band for the current frame frequency-domain signal is higher than a corresponding second spectral envelope threshold value, when the energy average value of the low-band frequency-domain signal is less than the energy average value of the high-band frequency-domain signal, wherein the first modification coefficient is set to be $\phi$ ranging in (0, 1); and wherein the second modification coefficient is set to be $\beta$ ranging in (1, 2).

10. A method for processing a signal, comprising:

obtaining an amplitude of at least one frequency-domain coefficient of a current frame frequency-domain signal;

obtaining at least one current frame modification coefficient corresponding to the at least one frequency-domain coefficient according to the amplitude of the at least one frequency-domain coefficient and an amplitude average value of the frequency-domain coefficients, wherein the amplitude average value of the frequency-domain coefficients is an amplitude average value of at least two consecutive frequency-domain coefficients in the current frame frequency-domain signal, and wherein the at least two consecutive frequency-domain coefficients include the at least one current frequency-domain coefficient;

obtaining a weighted modification coefficient of the current frame frequency-domain signal corresponding to the at least one frequency-domain coefficient by using the at least one current frame modification coefficient and a relevant frame modification coefficient, wherein the relevant modification coefficient comprises a modification coefficient of a sub-band for one or more previous frame frequency-domain signals; and modifying the corresponding at least one frequency-domain coefficient of the current frame frequency-domain signal by using the weighted modification coefficient.

11. The method for processing a signal according to claim 10, wherein before obtaining the at least one current frame modification coefficient corresponding to the at least one frequency-domain coefficient according to the amplitude of the at least one frequency-domain coefficient and the amplitude average value of the frequency-domain coefficients of the current frame frequency-domain signal, the method further comprises determining whether an energy average value of a low-band frequency-domain signal of the current frame frequency-domain signal is less than an energy average value of a high-band frequency-domain signal of the current frame frequency-domain signal.

12. The method for processing a signal according to claim 11, wherein obtaining the at least one current frame modification coefficient corresponding to the at least one frequency-domain coefficient according to the amplitude of the at least one frequency-domain coefficient and the amplitude average value of the frequency-domain coefficients, wherein the amplitude average value of the frequency-domain coefficients is the amplitude average value of at least two consecutive frequency-domain coefficients in the current frame frequency-domain signal, and wherein the at least two consecutive frequency-domain coefficients include the at least one current frequency-domain coefficient, comprises:

setting the current frame modification coefficient to be a first modification coefficient, if the amplitude is less than a first frequency-domain coefficient threshold value determined according to the amplitude average value, when the energy average value of the low-band frequency-domain signal is less than the energy average value of the high-band frequency-domain signal; and setting the current frame modification coefficient to be a second modification coefficient, if the amplitude of the frequency-domain coefficient of the current frame frequency-domain signal is higher than a second frequency-domain coefficient threshold value determined according to the amplitude average value, when the energy average value of the low-band frequency-domain signal is less than the energy average value of the high-band frequency-domain signal.

13. The method for processing a signal according to claim 10, wherein obtaining the weighted modification coefficient of the current frame frequency-domain signal corresponding to the at least one frequency-domain coefficient by using the at least one current frame modification coefficient and the relevant frame modification coefficient comprises:

performing a weight sum operation on the at least one current frame modification coefficient and the relevant frame modification coefficient; and using an operation result as the weighted modification coefficient of the current frame frequency-domain signal corresponding to the at least one frequency-domain coefficient.

14. The method for processing a signal according to claim 10, wherein modifying the corresponding at least one frequency-domain coefficient of the current frame frequency-domain signal by using the weighted modification coefficient comprises linearly transforming the corresponding at least one frequency-domain coefficient of the current frame frequency-domain signal with the weighted modification coefficient as a transform factor.

15. The method for processing a signal according claim 10, wherein after modifying the corresponding at least one frequency-domain coefficient of the current frame frequency-domain signal by using the weighted modification coefficient, the method further comprises performing intra-frame smoothing processing in a frequency-domain axis on the frequency-domain signal.

16. An apparatus for processing a signal, comprising:

an obtaining unit configured to obtain an amplitude of at least one frequency-domain coefficient of a current frame frequency-domain signal;

a current frame modification coefficient obtaining unit configured to compare the amplitude of the at least one frequency-domain coefficient with an amplitude average value of the frequency-domain coefficients and obtain at least one current frame modification coefficient corresponding to the at least one frequency-domain coefficient, wherein the amplitude average value of the frequency-domain coefficients is an amplitude average value of at least two consecutive frequency-domain coefficients in the current frame frequency-domain signal, and wherein the at least two consecutive frequency-domain coefficients include the at least one current frequency-domain coefficient;

a weighted modification coefficient obtaining unit configured to obtain a weighted modification coefficient of the current frame frequency-domain signal corresponding to the at least one frequency-domain coefficient by using the at least one current frame modification coefficient and a relevant frame modification coefficient, wherein the relevant frame modification coefficient comprises a modification coefficient of one or more previous frame frequency-domain signals; and a modifying unit configured to use a processor to modify the corresponding at least one frequency-domain coefficient of the current frame frequency-domain signal by using the weighted modification coefficient.

17. The apparatus for processing a signal according to claim 16, further comprising a determining unit configured to determine that an energy average value of a low-band frequency-domain signal of the current frame frequency-domain signal is less than an energy average value of a high-band frequency-domain signal of the current frame frequency-domain signal.

18. The apparatus for processing a signal according to claim 16, wherein the determining unit comprises:

a signal dividing module configured to divide the current frame frequency-domain signal into the high-band frequency-domain signal and the low-band frequency-domain signal; and a judging module configured to judge magnitudes of the energy average values of the low-band frequency-domain signal of the current frame frequency-domain signal and the high-band frequency-domain signal of the current frame frequency-domain signal.

19. The apparatus for processing a signal according to claim 18, wherein the weighted modification coefficient obtaining unit comprises:

a first modification coefficient obtaining sub-module configured to set the current frame modification coefficient to be a first modification coefficient, if the amplitude is less than a first frequency-domain coefficient threshold value determined according to the amplitude average value, when the energy average value of the low-band frequency-domain signal is less than the energy average value of the high-band frequency-domain signal; and a second modification coefficient obtaining sub-module configured to set the current frame modification coefficient to be a second modification coefficient, if the amplitude of the frequency-domain coefficient of the current frame frequency-domain signal is higher than a second frequency-domain coefficient threshold value determined according to the amplitude average value, when the energy average value of the low-band frequency-domain signal is less than the energy average value of the high-band frequency-domain signal.

20. The apparatus for processing a signal according to claim 16, further comprising a signal processing unit configured to perform intra-frame smoothing processing in a frequency-domain axis on the output frequency-domain signal after the corresponding at least one frequency-domain coefficient of the current frame frequency-domain signal is modified.

* * * * *